US006080075A

United States Patent [19]

Wussow et al.

[11] Patent Number: 6,080,075

[45] Date of Patent: Jun. 27, 2000

[54] COMPACT ACTUATOR FOR A THROTTLE ASSEMBLY

[75] Inventors: James M. Wussow; Jose L. Arras, both of El Paso, Tex.

[73] Assignee: Dana Corporation, Toledo, Ohio

[21] Appl. No.: 09/239,270

[22] Filed: Jan. 29, 1999

[51] Int. Cl.[7] ..... F02D 11/10

[52] U.S. Cl. ..... 475/149; 475/337; 475/269; 123/399; 251/294

[58] Field of Search ..... 475/149, 337, 475/269; 251/294, 129.11; 123/399, 361

[56] References Cited

U.S. PATENT DOCUMENTS

| | | | |
|---|---|---|---|
| 1,843,987 | 2/1932 | Ragan | 475/337 X |
| 2,408,993 | 10/1946 | Nardone | 475/337 X |
| 2,497,659 | 2/1950 | Davis et al. | 475/337 X |
| 3,892,144 | 7/1975 | Kirkegaard | 475/149 |
| 4,321,992 | 3/1982 | Gallo | 192/81 C |
| 4,756,287 | 7/1988 | Sakakibara et al. | 123/342 |
| 4,809,656 | 3/1989 | Suzuki | 123/399 X |
| 4,907,553 | 3/1990 | Porter | 123/400 |
| 4,932,375 | 6/1990 | Burney | 123/361 |
| 4,938,327 | 7/1990 | Tominaga | 123/361 X |
| 5,016,589 | 5/1991 | Terazawa | 123/399 |
| 5,022,369 | 6/1991 | Terazawa | 123/399 |
| 5,040,508 | 8/1991 | Watanabe | 123/399 X |
| 5,056,613 | 10/1991 | Porter et al. | 180/178 |
| 5,092,296 | 3/1992 | Gunter et al. | 123/399 X |
| 5,345,157 | 9/1994 | Suzuki et al. | 123/400 X |
| 5,433,181 | 7/1995 | Suzuki | 123/399 |
| 5,595,089 | 1/1997 | Watanabe et al. | 475/149 X |

*Primary Examiner*—Charles A Marmor
*Assistant Examiner*—Ankur Parekh
*Attorney, Agent, or Firm*—Dykema Gossett PLLC

[57] ABSTRACT

An actuator for a speed control device is provided. The actuator includes a motor, first and second planetary gear assemblies, and an output shaft. The motor drives a shaft on which a first pinion is mounted. The first pinion, in combination with an internal gear, causes a first planetary gear to rotate which in turn causes rotation in a first carrier supporting the first planetary gear. Rotation of the first carrier causes a second pinion disposed on an opposite side of the first carrier to rotate. The second pinion, in combination with the above-mentioned internal gear, causes a second planetary gear to rotate which in turn causes rotation in a second carrier supporting the second planetary gear. Rotation of the second carrier is transmitted to the output shaft directly or through an intermediate clutch.

11 Claims, 3 Drawing Sheets

COMPACT ACTUATOR FOR A THROTTLE ASSEMBLY

BACKGROUND OF THE INVENTION

1. Field of the Invention

This invention relates to speed control devices for automobiles and other vehicles and, in particular, to an improved actuator for such devices.

2. Disclosure of Related Art

In a conventional speed control device, an actuator controls a cable assembly or similar mechanism which in turn controls the throttle valve in a throttle assembly. Conventional actuators may include a motor having an first shaft extending therefrom and one or more gears through which rotation of the first shaft causes rotation in a second shaft used to control the cable assembly. These conventional actuators often employ gear arrangements that consume relatively large amounts of space, are relatively expensive, and require relatively large amounts of manufacturing and assembly time. Conventional actuators may also employ a clutch for selectively transmitting torque from the gear arrangement to the second shaft. Similarly, however, the clutches found in conventional actuators consume relatively large amounts of space, are relatively expensive, and substantially increase the number of components in the actuator—thereby significantly increasing manufacturing and assembly time for the actuator.

There is thus a need for an actuator for a speed control device that will minimize or eliminate one or more of the above-mentioned deficiencies.

SUMMARY OF THE INVENTION

The present invention provides an actuator for a speed control device.

An object of the present invention is to provide an actuator that is smaller, requires less time to manufacture and assemble, and is less expensive than conventional actuators yet is capable of generating an equal or greater torque as compared to conventional actuators.

An actuator in accordance with the present invention includes a motor having a first shaft extending therefrom along a first axis. The actuator also includes a first planetary gear assembly coupled to the first shaft and configured to rotate responsive to rotation of the first shaft. The first gear assembly may include a first pinion disposed at a first end of the first shaft, an internal gear disposed radially outwardly of the first pinion, and a first planetary gear disposed radially outwardly of the first pinion and radially inwardly of the internal gear. The first gear assembly may also include a first carrier axially spaced from the first pinion and on which the first planetary gear is supported. The actuator may further include a second planetary gear assembly configured to rotate responsive to rotation of the first planetary gear assembly. The second gear assembly may include a second pinion coupled to the first carrier of the first planetary gear assembly, the above-mentioned internal gear, and a second planetary gear disposed radially outwardly of the second pinion and radially inwardly of the internal gear. The second gear assembly may also include a second carrier axially spaced from the second pinion and on which the second planetary gear is supported. Finally, an actuator in accordance with the present invention may include a second that rotates responsive to rotation of the second carrier.

An actuator in accordance with the present invention is relatively compact as compared to conventional actuators used in connection with speed control devices. As a result, the actuator consumes less space than conventional actuators—a feature that is particularly desirable in vehicular and other applications. Further, the inventive actuator is also less expensive and consumes less manufacturing and assembly time as compared to conventional actuators for speed control devices.

An actuator in accordance with the present invention may further include a clutch disposed between the second planetary gear assembly and the second shaft for selectively transmitting torque from the second carrier to the second shaft. In accordance with the objectives of the present invention, the clutch may include several features designed to reduce the overall size, cost and manufacturing and assembly time of the actuator. In particular, the clutch may include an input hub that is integral with the second carrier. The clutch may also include a wrap spring that may be connected directly to the second carrier. Finally, the clutch may be constructed in the manner described in commonly assigned U.S. patent application Ser. No. 09/023,525, the entire disclosure of which is incorporated herein by reference. In particular, the clutch may include a control collar disposed about the input hub of the clutch and having an annular flange that is axially adjacent a corresponding flange in a coil housing of the clutch. The disclosed clutch is able to generates a high torque output despite its relatively small size and despite using a relatively low power input.

These and other features and objects of this invention will become apparent to one skilled in the art from the following detailed description and the accompanying drawings illustrating features of this invention by way of example.

DETAILED DESCRIPTION OF THE PREFERRED EMBODIMENT

Figures 1, 2:
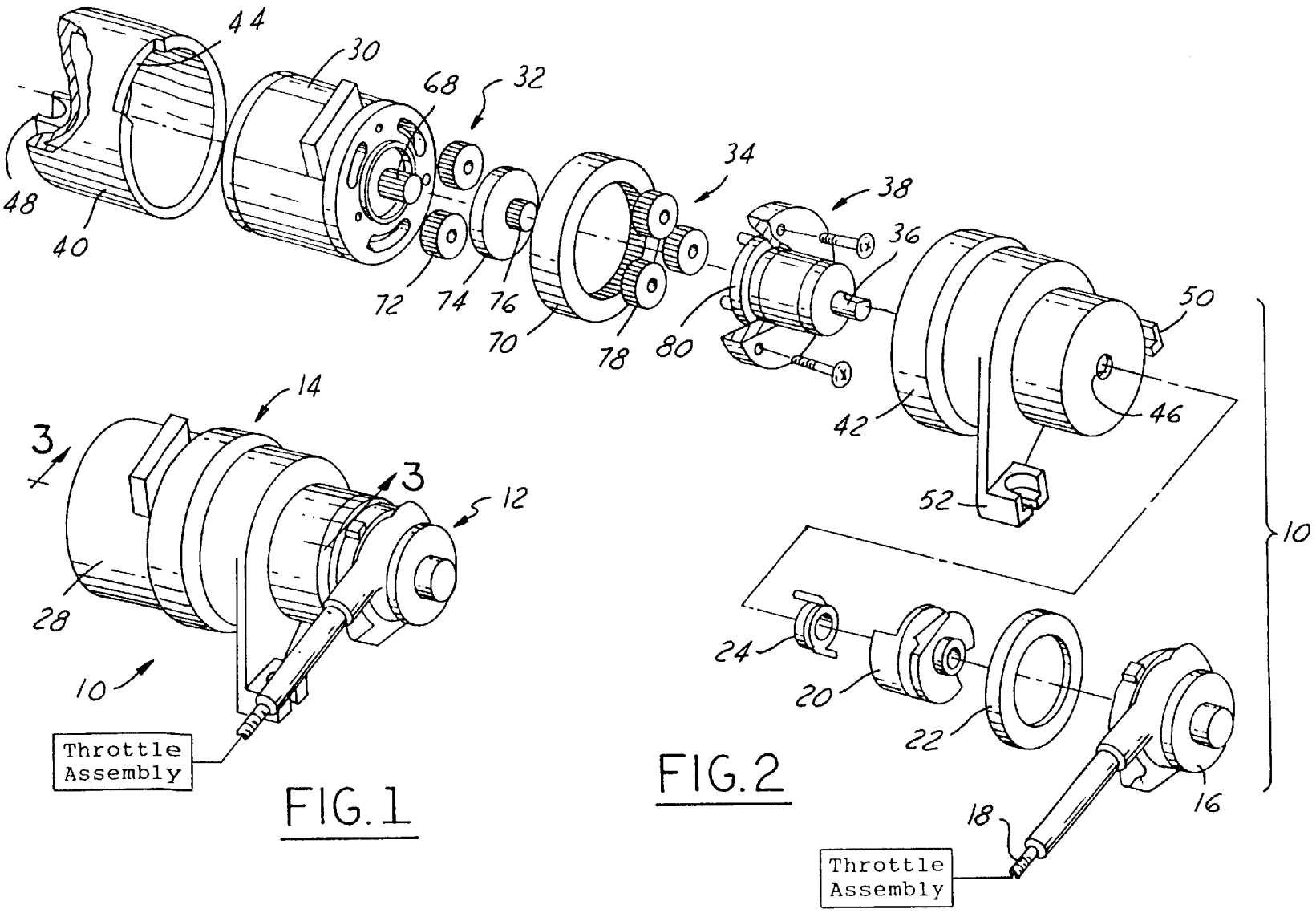
FIG. 1 is a perspective view of a speed control device including an actuator in accordance with the present invention.
FIG. 2 is an exploded, perspective view of the speed control device of FIG. 1.

Referring now to the drawings wherein like reference numerals are used to identify identical components in the various views, FIGS. 1 and 2 illustrate a speed control device 10 in accordance with the present invention. Device 10 may include means, such as a cable assembly 12, for controlling a throttle assembly, and an actuator 14 in accordance with the present invention.

Cable assembly 12 is provided to control a throttle assembly—and in particular a throttle valve. Assembly 12 is conventional in the art and may include a plurality of conventional components including cover assembly 16, cable 18, spool 20, seal 22, and return spring 24. Cover assembly 16 is provided to house cable 18 and spool 20. Cable 18 is provided to actuate the throttle assembly and is wound upon spool 20 which may be connected to an output shaft 36 extending from actuator 14. Seal 22 is provided to prevent the loss of lubricants from cover assembly 16 and the introduction of foreign objects into cover assembly 16. Finally, return spring 24 is provided to bias spool 20, and therefore, cable 18 and the throttle assembly, to a predetermined position.

Figure 3:
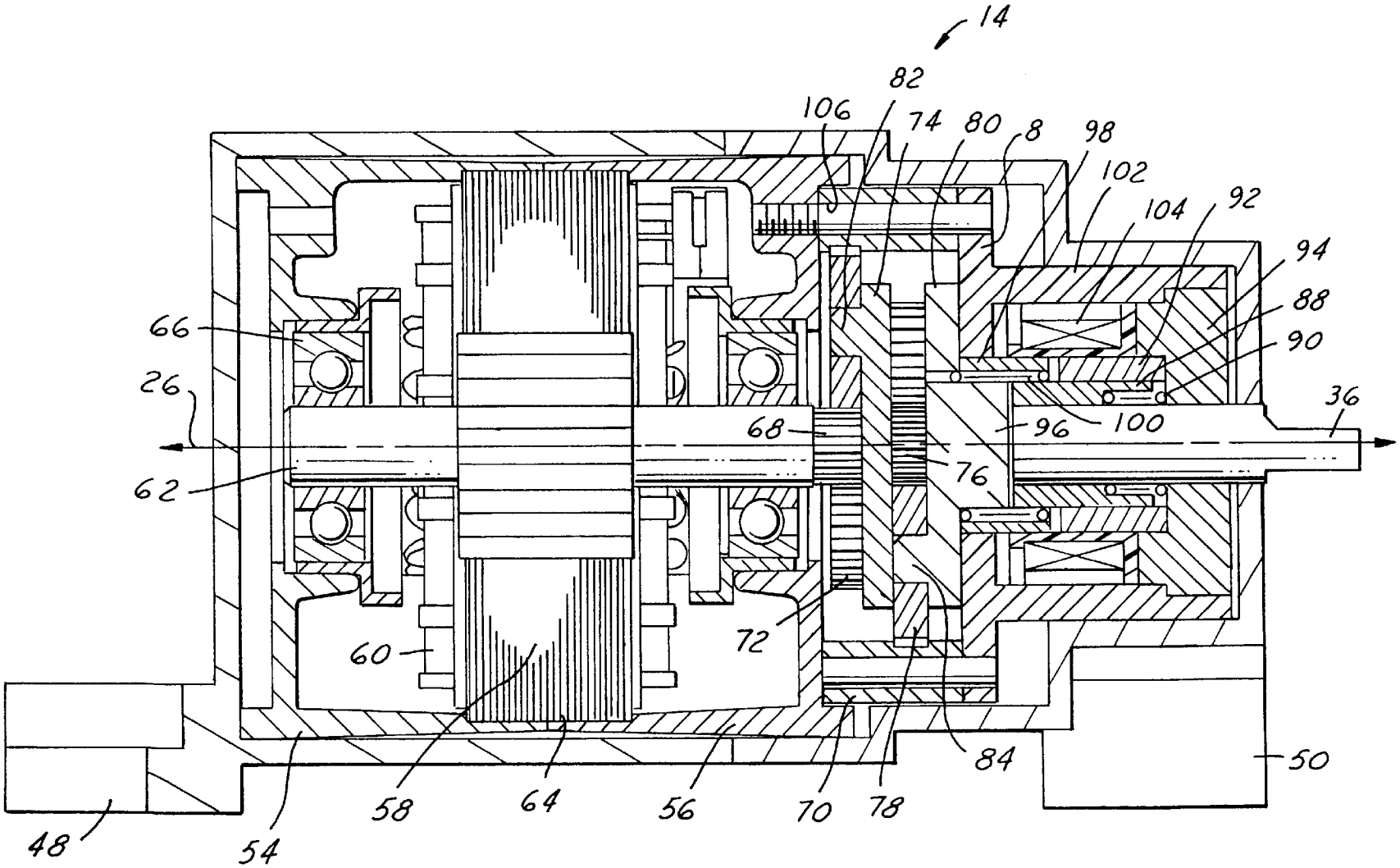
FIG. 3 is a cross-sectional view of the actuator shown in FIG. 1 taken substantially along lines 3—3.

Actuator 14 is provided to control cable assembly 12, and in turn, a throttle assembly. Referring to FIGS. 2 and 3, actuator 14 may be disposed about an axis 26 and may include a housing 28, a motor 30, a first planetary gear assembly 32, a second planetary gear assembly 34, and an output shaft 36. Actuator 14 may further include a clutch 38.

Housing 28 is provided as a means for supporting the component parts of actuator 14, preventing the introduction of foreign elements or objects into actuator 14, and preventing the expulsion of materials in the event of a failure of a component of actuator 14. Housing 28 may be made from a variety of conventional materials including conventional metals or plastics. Housing 28 may comprise a first section 40 and a second section 42 and may be centered about axis 26. Section 40 may include an aperture 44 to allow external electric control of motor 30. Section 42 includes an aperture 46 through which output shaft 36 extends. Housing 28 may further include a plurality of mounting members 48, 50, 52. In the illustrated embodiment, housing 28 includes three mounting members 48, 50, 52 that allow housing 28 to be mounted to irregular surfaces in a stable manner. It should be understood, however, that the number of mounting members may vary and that housing 28 may be mounted for use with a throttle assembly in a variety of ways.

Motor 30 is provided to drive output shaft 36 of actuator 14. Motor 30 is conventional in the art and may comprise a stepper motor. Referring to FIG. 3, motor 30 may include a housing (formed from a pair of opposing end bells 54, 56), a stator 58, a rotor 60, and a shaft 62.

End bells 54, 56, are provided as a means for supporting the component parts of motor 30, preventing the introduction of foreign elements or objects into motor 30, and preventing the expulsion of materials in the event of a failure of a component of motor 30. End bells 54, 56 may be made from a variety of conventional materials including conventional metals or plastics.

Stator 58 is provided to cause selective, incremental rotation of rotor 60 and shaft 62. Stator 58 is conventional in the art and may comprise a plurality of laminations 64 made from a material having a relatively low magnetic reluctance, such as iron. Stator 58 may be centered about axis 26 and may include a plurality of radially inwardly extending stator poles (not shown), each of which may have one or more radially inwardly extending teeth (not shown). As is known in the art, phase coils (not shown) may be wound about the stator poles and may be sequentially energized to create magnetic fields about the stator poles and thereby generate a relatively constant torque acting on rotor 60.

Rotor 60 is provided to impart torque to shaft 62. Rotor 60 is conventional in the art and may also comprise a plurality of laminations made from a material having a relatively low magnetic reluctance, such as iron. Rotor 60 is disposed radially inwardly of stator 58 and may be centered about axis 26. Rotor 60 may include a plurality of radially outwardly extending rotor poles (not shown), each of which may have one or more radially outwardly extending teeth (not shown).

Shaft 62 is provided to drive first planetary gear assembly 32. Shaft 62 is conventional in the art and may be coupled to rotor 60 for rotation therewith. In particular, shaft 62 may include a key (not shown) disposed within a keyway (not shown) in rotor 60. Shaft 62 may be centered about axis 26 and each end of shaft 62 may be rotatably supported by one or more bearings 66 that are supported within end bells 54, 56.

First and second planetary gear assemblies 32, 34 are provided as a means for imparting a predetermined degree of rotation to output shaft 36 responsive to rotation of shaft 62. Assembly 32 may include a pinion 68, an internal gear 70, one or more planetary gears 72, and a carrier 74. Assembly 34 may include a pinion 76, internal gear 70, one or more planetary gears 78, and a carrier 80.

Pinion 68 and internal gear 70 are provided to impart rotation to planetary gears 72 and are conventional in the art. Pinion 68 is disposed at a first end of shaft 62 and may be centered about axis 26. Pinion 68 rotates responsive to rotation of shaft 62 and may be mounted to shaft 62 or made integral therewith. Internal gear 70 is disposed radially outwardly of pinion 68, planetary gears 72, and carrier 74, and may also be centered about axis 26. Internal gear 70 may also be disposed radially outwardly of pinion 76, planetary gears 78, and carrier 80. Internal gear 70 is fixed against rotation and may be connected to end bell 56 via a screw, bolt or other fastening means.

Planetary gears 72 are provided to impart a predetermined degree of rotation to carrier 74 responsive to rotation of shaft 62. Gears 72 are conventional in the art and mesh with pinion 68 and internal gear 70. Gears 72 are disposed on a first side of carrier 74 and are disposed radially outwardly of pinion 68 and radially inwardly of internal gear 70. In the illustrated embodiment, there are three planetary gears 72 within first planetary gear assembly 32. It should be understood, however, that the number of planetary gears 72 may vary.

Carrier 74 is provided to support planetary gears 72 and to impart rotational force to second planetary gear assembly 34. Carrier 74 is conventional in the art. Carrier 74 is axially spaced from pinion 68 and may be centered about axis 26. Carrier 74 includes one or more axial extensions 82 on which planetary gears 72 are supported.

Pinion 76 is provided, along with internal gear 70, to impart rotation to planetary gears 78 and is conventional in the art. Pinion 76 rotates responsive to rotation of carrier 80 and may be coupled to carrier 80 or made integral therewith. Pinion 76 may be centered about axis 26 and is disposed on a second side of carrier 74 opposite planetary gears 72.

Planetary gears 78 are provided to impart a predetermined degree of rotation to carrier 80 responsive to rotation of carrier 74. Gears 78 are conventional in the art and mesh with pinion 76 and internal gear 70. Gears 78 are disposed radially outwardly of pinion 76 and radially inwardly of internal gear 70. In the illustrated embodiment, there are three planetary gears 78 within second planetary gear assembly 34. It should be understood, however, that the number of planetary gears 78 may vary.

Carrier 80 is provided to support planetary gears 78 and to impart rotational force to output shaft 36. Carrier 80 is conventional in the art. Carrier 80 is axially spaced from pinion 76 and may be centered about axis 26. Carrier 80 includes one or more axial extensions 84 on which planetary gears 78 are supported.

Output shaft 36 is provided to actuate cable assembly 12 or another system for controlling a throttle assembly. Shaft 36 is conventional in the art. Shaft 36 may be centered about axis 26 and extends axially through aperture 46 in section 42 of housing 28. Shaft 36 rotates responsive to rotation of carrier 80. In one embodiment of the present invention shaft 36 may be coupled directly to carrier 80 or made integral with carrier 80. In an alternative embodiment of the present invention, clutch assembly 38 is disposed between carrier 80 and shaft 36 to cause selective rotation of shaft 36 responsive to rotation of carrier 80.

Referring again to FIG. 3, clutch 38 is provided to selectively transmit torque from carrier 80 of gear assembly 34 to output shaft 36. Clutch 38 may include an end plate 86, a shaft hub 88, a compression spring 90, a shaft sleeve 92, an end hub 94, an input hub 96, a control collar 98, a wrap spring 100, an annular coil housing 102 and a coil 104.

End plate 86 is provided to maintain the physical location and relationship of the component parts of both clutch 38 and actuator 14 as a whole. End plate 86 may be annular and may be centered about axis 26. End plate 86 may be made from a variety of conventional materials including powdered metals. As shown in FIG. 3, plate 86 may include one or more axially extending bores 106 configured to receive bolts, screws or other means for fastening plate 86 to internal gear 70 and end bell 56 of motor 30.

Shaft hub 88 provides an engagement surface for wrap spring 100 upon actuation of clutch 38. Shaft hub 88 is conventional in the art and is preferably made from a material having a relatively high magnetic reluctance. Hub 88 is annular and may be centered about axis 26. Hub 88 is coupled to shaft 36 for rotation therewith.

Spring 90 is provided to bias shaft hub 88 away from input hub 96. Spring 90 is conventional in the art and may be made from a variety of conventional materials including conventional metals and metal alloys. Spring 90 may be anchored at one end to shaft hub 88 and at a second end to end hub 94.

Sleeve 92 provides an engagement surface for control collar 98 upon actuation of clutch 38 and, upon energization of coil 104, forms part of a magnetic circuit that draws collar 98 into engagement with sleeve 92. Sleeve 92 is conventional in the art and is preferably made from a material having a relatively low magnetic reluctance. Sleeve 92 is annular and is disposed radially outwardly of shaft 36. Sleeve 92 may be centered about axis 26. It will be understood by those in the art that sleeve 92 may be integrated with shaft hub 88 to form a single unit.

End hub 94 forms part of a magnetic circuit for the transfer of magnetic flux between sleeve 92 and coil housing 102. Hub 94 is preferably made from a material having a relatively low magnetic reluctance such as powdered iron. Hub 94 is annular and may be centered about axis 26. Hub 94 may be disposed radially outwardly of shaft 36 and radially inwardly of coil housing 102.

Figure 4:
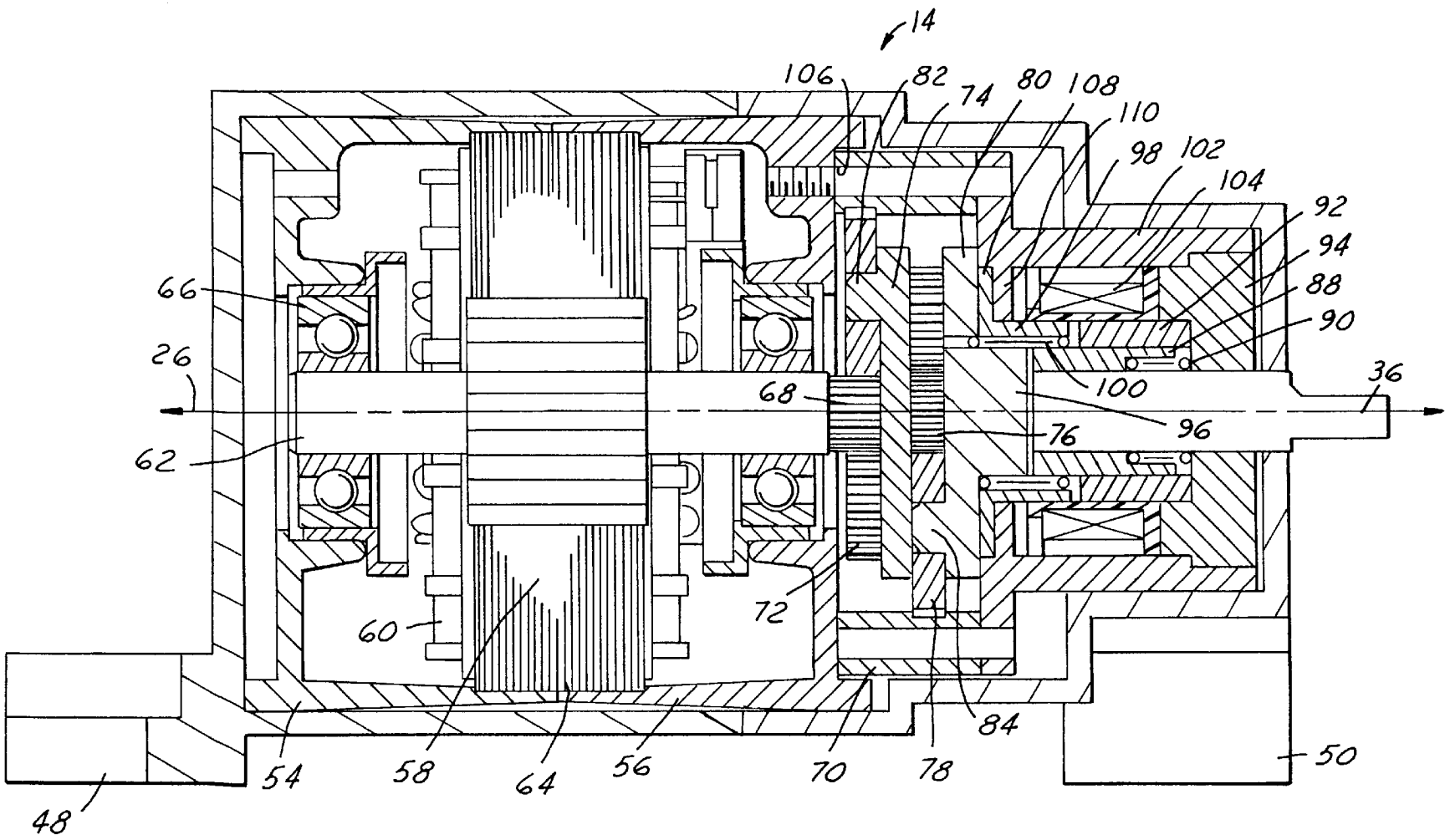
FIG. 4 is a cross-sectional view of an actuator in accordance with the present invention incorporating an alternative clutch design.

Input hub 96 provides the rotational force used to drive output shaft 36. Hub 96 is preferably composed of a material having a relatively high magnetic reluctance. Hub 96 extends axially from carrier 80 and rotates responsive to rotation of carrier 80. Hub 96 may be coupled to carrier 80. In accordance with the objectives of the present invention, however, input hub 96 may alternatively be made integral with carrier 80 (as shown in FIGS. 3 and 4) to thereby reduce the number of components, the size, and the cost of actuator 14. Hub 96 is axially spaced from shaft 36 and shaft hub 88 and may be centered about axis 26.

Control collar 98 is provided to selectively, frictionally engage sleeve 92 and may be made from a material, such as powdered iron, having a relatively low magnetic reluctance. Collar 98 is annular, may be centered about axis 26, and may be disposed radially outwardly of input hub 96, spring 100, shaft hub 88, and shaft 36. Collar 98 is coupled to one end of spring 100, the other end of which is connected to input hub 96. Like input hub 96, collar 98 is rotatable relative to shaft 36. Referring now to FIG. 4, in an alternate embodiment, a control collar 98' may be provided. Collar 98' is substantially L-shaped in radial cross-section, having a radially outwardly extending annular flange 108. As described in greater detail in commonly assigned U.S. patent application Ser. No. 09/023,525, the entire disclosure of which is incorporated herein by reference, the construction of collar 98' relative to coil housing 102 results in a high level of magnetic attraction between collar 98 and housing 102 upon energization of coil 104. As a result, the engagement between collar 98 and shaft sleeve 92 will enable transmission of a relatively high level of torque despite a low power input to coil 104.

Wrap spring 100 is provided to securely engage shaft hub 88 and input hub 96 upon the frictional engagement of sleeve 92 and collar 98. Spring 100 is conventional in the art and may be made from known materials such as music wire. Spring 100 may be connected at one end to carrier 80 or input hub 96 and at a second end to collar 98 by first and second tangs (not shown), respectively, that may be inserted within corresponding notches cut within carrier 80 or input hub 96 and control collar 98, respectively.

Referring again to FIG. 3, coil housing 102 is provided to house coil 104 and to form part of a magnetic circuit for the transfer of magnetic flux within clutch 38. Housing 102 may be made from a material having a relatively low magnetic reluctance, such as powdered iron. Housing 102 is annular and may be centered about axis 26. Housing 102 is disposed radially outwardly of sleeve 92 and may be integral with end plate 86. Housing 102 may be substantially L-shaped in radial cross-section having a radially inwardly extending annular flange 110. Referring again to FIG. 4, flange 110 may be axially adjacent flange 108 of collar 98.

Coil 104 is provided to generate a magnetic field, and create a magnetic flux circuit among the magnetically permeable components of clutch 38, when current is supplied to coil 104. Coil 104 is conventional in the art and may be made from known materials such as copper. Coil 104 is disposed within housing 102 and current is supplied to coil 104 through housing 102 by a power source (not shown).

An actuator 14 in accordance with the present invention represents an improvement over conventional actuators used in connection with speed control devices. The gear arrangement of the inventive actuator 14 results in an actuator 14 that is smaller and more compact than conventional actuators and, therefore, consumes less space than conventional actuators. The inventive actuator 14 is also less expensive and requires less manufacturing and assembly time to construct as compared to conventional actuators.

While the invention has been particularly shown and described with reference to the preferred embodiments thereof, it is well understood by those skilled in the art that various changes and modifications can be made in the invention without departing from the spirit and scope of the invention.

We claim:

1. An actuator for a speed control device, comprising:

a motor having a first shaft extending therefrom, said first shaft disposed about a first axis;

a first pinion disposed proximate one end of said first shaft;

an internal gear disposed radially outwardly of said first pinion;

a first planetary gear disposed radially outwardly of said first pinion and radially inwardly of said internal gear;

a first carrier on which said first planetary gear is supported;

a second pinion disposed on a side of said first carrier opposite said first planetary gear;

a second planetary gear disposed radially outwardly of said second pinion and radially inwardly of said internal gear;

a second carrier on which said second planetary gear is supported;

a second shaft;

a clutch that selectively transmits torque from said second carrier to said second shaft;

wherein said clutch includes a wrap spring connected to said second carrier.

2. An actuator for a speed control device, comprising:

a motor having a first shaft extending therefrom, said first shaft disposed about a first axis;

a first pinion disposed proximate one end of said first shaft;

an internal gear disposed radially outwardly of said first pinion;

a first planetary gear disposed radially outwardly of said first pinion and radially inwardly of said internal gear;

a first carrier on which said first planetary gear is supported;

a second pinion disposed on a side of the first carrier opposite said first planetary gear;

a second planetary gear disposed radially outwardly of said second pinion and radially inwardly of said internal gear;

a second carrier on which said second planetary gear is supported;

a second shaft;

a clutch that selectively transmits torque from said second carrier to said second shaft;

wherein said clutch includes:

an input hub extending axially from said second carrier;

a wrap spring connected to one of said input hub and said second carrier;

an annular control collar coupled to said wrap spring;

a shaft hub mounted to said second shaft for rotation therewith;

a shaft sleeve disposed radially outwardly of a portion of said shaft hub; and, means for selectively urging said control collar into engagement with said shaft sleeve.

3. The actuator of claim 2 wherein said control collar includes a radially outwardly extending flange.

4. A speed control device, comprising an actuator including a motor having a first shaft extending therefrom, said first shaft disposed about a first axis;

a first pinion disposed proximate one end of said first shaft;

an internal gear disposed radially outwardly of said first pinion;

a first planetary gear disposed radially outwardly of said first pinion and radially inwardly of said internal gear;

a first carrier on which said first planetary gear is supported;

a second pinion disposed on a side of said first carrier opposite said first planetary gear;

a second planetary gear disposed radially outwardly of said second pinion and radially inwardly of said internal gear a second carrier on which said second planetary gear is supported; and, a second shaft that rotates responsive to rotation of said second carrier; and, means for controlling a throttle assembly of a vehicle responsive to rotation of said second shaft.

5. The speed control device of claim 4, further comprising a housing from which said second shaft extends, said housing including first, second, and third mounting members.

6. The speed control device of claim 4, further comprising a third planetary gear coupled to one of said first and second carriers.

7. The speed control device of claim 4, further comprising a clutch that selectively transmits torque from said second carrier to said second shaft.

8. The speed control device of claim 7 wherein said clutch includes an input hub that is integral with said second carrier.

9. The speed control device of claim 7 wherein said clutch includes a wrap spring connected to said second carrier.

10. The speed control device of claim 7 wherein said clutch includes:

an input hub extending axially from said second carrier;

a wrap spring connected to one of said input hub and said second carrier;

an annular control collar coupled to said wrap spring;

a shaft hub mounted to said second shaft for rotation therewith;

a shaft sleeve disposed radially outwardly of said shaft hub; and, means for selectively urging said control collar into engagement with said shaft sleeve.

11. The speed control device of claim 10 wherein said control collar includes a radially outwardly extending flange.

* * * * *